United States Patent [19]

Stevens

[11] Patent Number: 4,948,100

[45] Date of Patent: Aug. 14, 1990

[54] STAIR RAIL FOR TODDLERS

[76] Inventor: Larry L. Stevens, P.O. Box 137, Williamsfield, Ohio 44093

[21] Appl. No.: 424,929

[22] Filed: Oct. 23, 1989

[51] Int. Cl.[5] ..... E04H 17/14

[52] U.S. Cl. ..... 256/65; 256/59; 248/220.1; 52/184

[58] Field of Search ..... 256/59, 65; 52/655, 52/650, 184, 690, 190; 182/106; 248/251, 220.1

[56] References Cited

U.S. PATENT DOCUMENTS

| | | | |
|---|---|---|---|
| 1,380,518 | 6/1921 | Bellig | 248/220.1 X |
| 3,018,077 | 1/1962 | Buehler | 256/65 |
| 3,026,080 | 3/1962 | Thurnauer | 248/251 |
| 3,433,460 | 3/1969 | Kusel et al. | 256/59 |
| 3,511,106 | 5/1970 | Deeby | 248/220.1 X |
| 3,788,608 | 1/1974 | Raymond et al. | 256/59 |
| 4,556,201 | 12/1980 | Turner | 256/59 |
| 4,757,653 | 7/1988 | Anderholm | 52/184 X |

FOREIGN PATENT DOCUMENTS

| | | | |
|---|---|---|---|
| 665058 | 10/1965 | France | 52/184 |
| 1160275 | 8/1969 | United Kingdom | 256/59 |
| 1418531 | 12/1975 | United Kingdom | 52/184 |

*Primary Examiner*—Andrew V. Kundrat
*Assistant Examiner*—Franco S. DeLiguori
*Attorney, Agent, or Firm*—Harpman & Harpman

[57] ABSTRACT

A stair rail assembly for attachment on a stairs provides a hand rail design for a toddler or a young child. Several heart-shaped mounted brackets having angular disposed tubular sockets thereon are secured to the stair structure or wall in engagement with the tread and riser portions of the stair and support outwardly angularly extending posts which carry T-fittings on their outer end which in turn engage a longitudinally extending hand rail positioned at an appropriate height so that it is conveniently engaged by a toddler or a young child. Fasteners, such as bolts or screws, are positioned through the heart-shaped mounted brackets to secure the same to the stair structure or wall.

6 Claims, 1 Drawing Sheet

STAIR RAIL FOR TODDLERS

BACKGROUND OF THE INVENTION

1. Technical Field:

This invention relates to stair rail assemblies of the type positioned alongside a stairway to provide a convenient hand rail.

2. Description of the Prior Art:

Prior structures of this type are usually affixed to the tread portions of a stairway and/or a wall against which the stairway is positioned.

U. S. Pat. No. 4,556,201 illustrates a conventional stair rail secured to a wall alongside a stairway and having a secondary, temporary hand rail positioned therebelow at a convenient height for small children or toddlers. The secondary hand rail is secured to the wall and to a plurality of elongated depending hanging devices which are attached to the conventional stair rail supports.

U. S. Pat. No. 3,788,608 illustrates a modular folding rail in which upright tubular sockets are affixed to the horizontal step portions of a bleacher structure and in which-posts are positioned so as to adjustably position a hand rail thereabove, and Pat. No. 3,433,460 illustrates a conventional hand rail and a means for mounting the same on a wall incorporating a novel mounting bracket and means therein for attaching the hand rail thereto.

The present invention discloses a stair rail for toddlers or young children in which mounting brackets having right angular surfaces engageable with tread and riser portions of a stairway are secured to the stair structure and/or a wall so as to desirably position the mounting brackets in fixed relation to the stair structure. Each of the mounting brackets has an angularly disposed tubular socket extending therefrom for the reception of posts which carry T-fittings on their outer ends in which a longitudinally extending stair rail is positioned. The angularly disposed tubular sockets on the mounting brackets position the posts at an angle from the vertical and at an angle from the side of the stair structure or wall so as to position the longitudinally extending hand rail in spaced relation to the wall and at a height where it is conveniently grasped by a young child or toddler.

SUMMARY OF THE INVENTION

A stair rail for toddlers comprises an assembly of several substantially heart-shaped mounting brackets, each of which has a pair of flat surfaces arranged at a 90° angle to one another so as to form a portion of a peripheral edge of the brackets, each of the mounting brackets has a tubular socket extending therefrom at an angle with respect to the plane of the bracket and oppositely disposed with respect to the apex of the right angular postions of the peripheral edge thereof. Posts are removably positioned in the tubular sockets and T-fittings on the other ends of the posts receive a longitudinally extending tubular hand rail. Bolts or other fasteners are positioned through the mounting bracket by which the mounting brackets are desirably positioned in engagement with the tread and riser portion of the stair so as to secure the same and the stair rail for toddlers to the stair structure and/or a wall against which the stair is positioned.

DESCRIPTION OF THE PREFERRED EMBODIMENT

Figure 1:
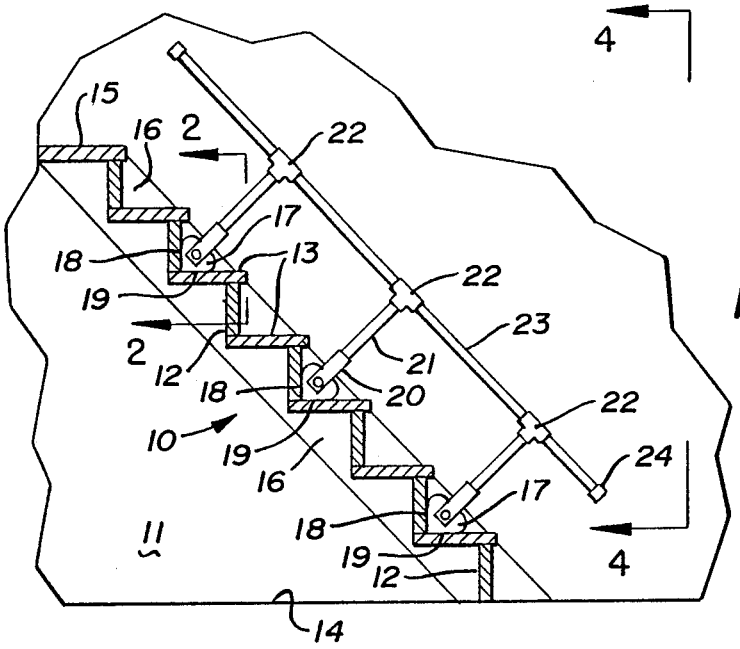
FIG. 1 is a side elevation of a stairway with parts in cross section showing the stair rail assembly positioned thereon.
Figure 4:
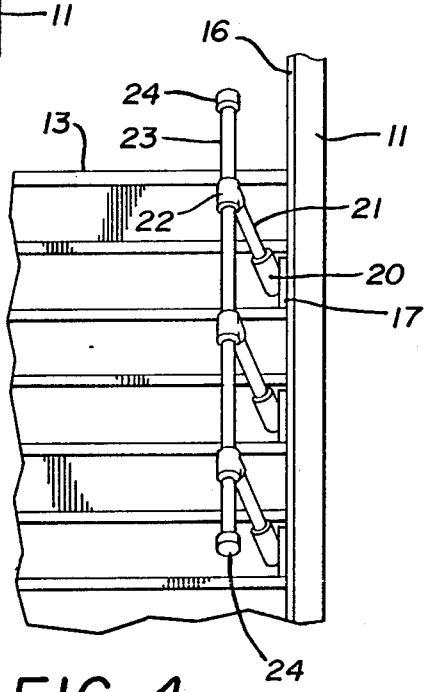
FIG. 4 is a plan view on line 4—4 of FIG. 1.

By referring to FIG. 1 of the drawings, it will be seen that a stair structure is generally indicated by the numeral 10 as being positioned alongside a wall 11, the stair structure including a plurality of risers 12 and treads 13 which extend from lower floor level 14 to an upper floor level 15. Elongated stair rails 16 are mounted on the ends of the risers 12 and treads 13 as will be understood by those skilled in the art. A plurality of generally heart-shaped mounting plates 17 are positioned along the stair structure and each of the generally heart-shaped mounting plates 17 is defined a peripheral edge, two adjacent portions of which 18 and 19 are arranged at a right angle to one another A back surface of each of the mounting plates 17 is flat and an oppositely disposed front surface of each of the plates 17 is substantially flat and carries an outwardly extending tubular socket 20 which is positioned at an angle with respect to the front and back surfaces of the generally heart-shaped mounting plate 17. Posts 21, which are preferably section of PVC pipe, are positioned in the tubular angularly disposed sockets 20 of the brackets 17 so that they extend outwardly and upwardly with respect to the stair structure so as to partially overlie the same as may best be seen in FIGS. 2 and 4 of the drawings.

Figure 2:
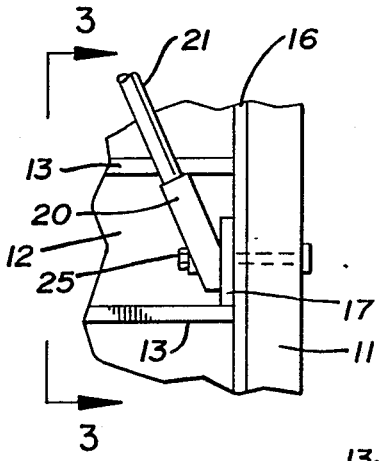
FIG. 2 is an enlarged section on line 2—2 of FIG. 1.
Figure 3:
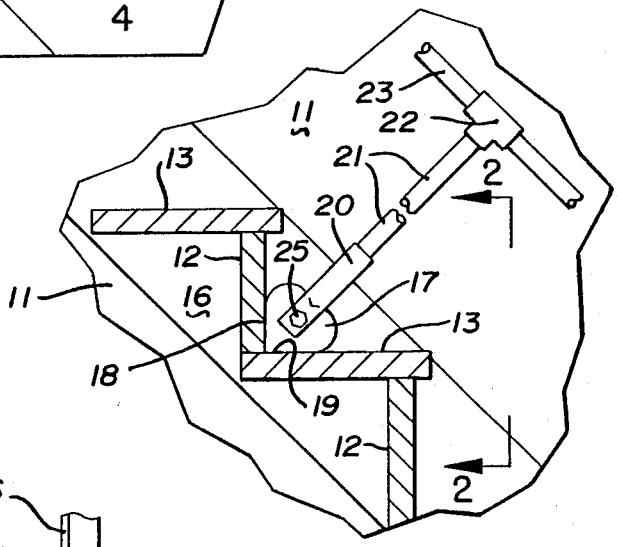
FIG. 3 is a side elevation with parts broken away and parts in cross section on line 3—3 of FIG. 2.

By referring to FIGS. 1 and 2 of the drawings, it will be seen that a plurality of T-fittings 22 are provided, one being positioned on the outer end of each of the posts 21 so that the T-fittings 22 are in line with one another and a longitudinally extending hand rail 23 is positioned therethrough and end caps 24 are positioned on its opposite ends. The T-fittings 22 are preferably formed of PVC (polyvinly chloride) and the hand rail 23 is preferably a section of PVC pipe so that the entire stair rail assembly is relatively lightweight, yet structurally strong. The several parts of the stair rail assembly may be secured to one another with suitable cement as known in the art. Each of the substantially heart-shaped brackets 17 is apertured centrally, the aperture extending through the lowermost portion of the angularly disposed tubular socket 20 so that a bolt 24 or similar fastening device can be positioned therethrough so as to engage the stair rail 16 and/or the wall 11 against which the stair rail 16 is usually positioned and as illustrated in FIG. 2 of the drawings.

In a conventional stairway in a typical dwelling house between 8 and 10 risers are employed with associated tread portions and stair rails to form a conventional stairway. The present invention provides a railing or hand rail that may be positioned at a desired height above the stairway, for example 15 inches, where a small child or toddler can readily grasp the same while climbing or descending the stairs. The stair rail assembly is easily assembled from relatively inexpensive materials, all of which are standard parts except the substantially heart-shaped mounting plates with their tubular sockets which may be inexpensively molded of PVC (polyvinyl chloride resin). The configuration of the substantially heart-shaped mounting plate 17 enables it to be firmly attached to the stair rail and/or a wall surface adjacent the stairway by a single fastener, such as a toggle bolt or a conventional bolt or screw.

It will thus be seen that a simple, inexpensive, easily assembled hand rail assembly has been disclosed which provides a practical and efficient hand rail for toddlers and small children and having thus described my invention what I claim is:

1. A mounting device for use in mounting a hand rail on a stairway having at least one stair rail and plurality of alternate tread and riser sections, the ends of said tread and riser sections engaging said stair rail, said mounting device comprising: a heart-shaped mounting plate having a peripheral edge with right angular surface positioned against a pair of said alternate tread and riser sections with said mounting plate engaging said stair rail, a fastener positioned through an aperture in said heart-shaped mounting plate inwardly of said peripheral edge for securing said mounting plate to said stair rail, an angularly disposed tubular socket on said heart-shaped mounting plate so that a post for supporting said hand rail can be positioned in said tubular socket on said heart-shaped mounting plate.

2. The mounting device claim 1 wherein said heart-shaped mounting plate has a flat side and said right angular surfaces the lower pointed part of the heart-shape.

3. Mounting devices for mounting a hand rail assembly on a vertically disposed member beside alternate horizontal tread and vertical riser portions of a stairway comprising:

at least two heart-shaped mounting plates, the peripheral edge of each of said flat heart-shaped mounting plates having right angular sections therein, each of said flat heart-shaped mounting plates positioned on said vertically disposed member, said angular sections engaging a pair of said alternate tread and riser portions of said stairway, tubular socket on each flat heart-shaped mounting plate extending outwardly therefrom on an angle with respect thereto, a fastener positioned through an aperture in each of said flat heart-shaped mounting plates securing said mounting plates to said vertically disposed member so that said mounting plates are fixed with respect to said pair of tread and riser portions, so that a post may be positioned in each of said tubular sockets and said hand rail mounted thereon.

4. The mounting devices of claim 3 wherein said vertically disposed member is a stair rail of a stairway to which said tread and riser portions are attached.

5. The mounting devices of claim 3 wherein said vertically disposed member is a wall beside a stairway.

6. A toddler's hand rail assembly for a stairway having a plurality of alternately positioned tread and riser portions, said assembly comprising mounting devices for use in mounting an elongated hand rail outwardly of a supporting surface and above and adjacent one of the ends of said tread and riser portions, said mounting devices comprising heart-shaped plates having a flat side secured to said supporting surface, tubular sockets formed integrally with said mounting plates extending outwardly therefrom at an angle thereto, tubular posts positioned in said tubular sockets, fittings on said posts and a tubular hand rail engaged in said fittings, said heart-shaped mounting plates having edge portions forming the lower pointed part of the heart-shape positioned in substantially right angular relation to one another and engaging adjacent tread and riser portions of said stairway.

* * * * *